US006089061A

United States Patent [19]

Haas et al.

[11] Patent Number: 6,089,061

[45] Date of Patent: Jul. 18, 2000

[54] MODULARIZED RECONFIGURABLE HEATED FORMING TOOL

[75] Inventors: Edwin Gerard Haas, Sayville; Robert Charles Schwarz, Huntington; John M. Papazian, Great Neck, all of N.Y.

[73] Assignee: Northrop Grumman Corporation, Los Angeles, Calif.

[21] Appl. No.: 09/310,664

[22] Filed: May 12, 1999

[51] Int. Cl.[7] ..... B21D 7/12

[52] U.S. Cl. ..... 72/14.8; 72/342.1; 72/413

[58] Field of Search ..... 72/14.8, 413, 403, 72/342.1, 306, 312

[56] References Cited

U.S. PATENT DOCUMENTS

| | | | |
|---|---|---|---|
| 1,673,564 | 6/1928 | Hathorn et al. . | |
| 1,776,082 | 9/1930 | Peterson . | |
| 2,280,359 | 4/1942 | Trudell | 113/44 |
| 4,212,188 | 7/1980 | Pinson | 72/413 |
| 4,294,102 | 10/1981 | Luckert et al. | 72/413 |
| 4,976,125 | 12/1990 | Wilson | 72/21 |
| 4,987,760 | 1/1991 | Schulte | 72/306 |
| 5,187,969 | 2/1993 | Morita | 72/413 |
| 5,471,856 | 12/1995 | Suzuki et al. | 72/1 |
| 5,546,784 | 8/1996 | Haas et al. | 72/413 |
| 5,954,175 | 9/1999 | Haas | 72/413 |

FOREIGN PATENT DOCUMENTS

| | | | |
|---|---|---|---|
| 900654 | 7/1962 | United Kingdom | 72/413 |
| 1242393 | 8/1971 | United Kingdom | 72/413 |

*Primary Examiner*—Daniel C. Crane
*Attorney, Agent, or Firm*—Terry J. Anderson; Karl J. Hoch, Jr.

[57] ABSTRACT

Tooling apparatus comprises opposing first and second dies adapted to receive a three-dimensional honeycomb core article therebetween and including opposedly aligned arrays of elongated mutually parallel translating pins, each terminating at a tip end and arranged in a matrix for longitudinal movement between a retracted position and an extended position engageable with the article. A controller individually moves each of the translating pins in a coordinated manner between the retracted and extended positions and into engagement with the article to form it to a predetermined contour. Each die includes a housing on which the translating pins are movably mounted, a plurality of drive output shafts each drivingly connected with an associated translating pin, and a transmission disposed in the base for independent driving controllable interconnection of each translating pin with a rotational drive source, and a controller interconnecting each transmission for selective energization thereof to thereby achieve selective rotation of at least one of the translating pins. The translating pins may have planar sides which prevent their rotation by the restraining action of adjacent translating pins. Each of the translating pins may define an internal cavity extending between bottom and tip ends, each being perforated and the apparatus may include a pump for delivering temperature controlled gas to each hollow pin tube for flow through the perforations in the bottom end, through the internal cavity, and out through the perforations in the tip end for delivery to cells of the article.

25 Claims, 6 Drawing Sheets

MODULARIZED RECONFIGURABLE HEATED FORMING TOOL

BACKGROUND OF THE INVENTION

1. Field of the Invention

The present invention relates generally to forming of honeycomb core and, more specifically, to computer-controlled tooling capable of providing an adjustable three dimensional surface for forming honeycomb core articles with the capability of applying or directing heated air or gas through the honeycomb core cells as well as providing rapid contour changes. The mechanism of the invention is comprised of a plurality of assembled modules which act in concert with one another to effect the work operation.

2. Description of the Prior Art

A pair of patents can be said to be generally representative of the present state of the art of forming complex metal shapes. A first instance is U.S. Pat. No. 4,212,188 to Pinson which discloses a plurality of longitudinally and laterally spaced and opposed die members in a matrix array for engaging and forming a sheet metal article interposed between them. Another instance is U.S. Pat. No. 5,546,784 to Haas et al. which discloses a computer controlled self adjusting sheet metal forming die which can provide rapid contour changes and comprises a computer control device which sends appropriately timed signals to translate each contour element so that a three dimension surface is formed by a discrete matrix of individual pins which press the sheet metal against a forming surface.

It was with knowledge of the foregoing state of the technology that the present invention has been conceived and is now reduced to practice.

SUMMARY OF THE INVENTION

The present invention relates to tooling apparatus which comprises first and second die modules adapted to receive a three-dimensional honeycomb core article there between. The tooling apparatus includes opposedly aligned arrays of elongated mutually parallel translating pins, each terminating at a tip end and arranged in a matrix for longitudinal movement between a retracted position and an extended position engageable with the article. A controller individually moves each of the translating pins in a coordinated manner between the retracted and extended positions and into engagement with the article to form it to a predetermined contour. Each die module includes a base on which the translating pins are movably mounted, a plurality of drive output shafts each drivingly connected with an associated translating pin, and a transmission disposed in the base for independent driving controllable interconnection of each translating pin with a common rotational drive source, and a controller interconnecting each transmission for selective energization thereof to thereby achieve selective rotation of at least one of the translating pins. The translating pins may have planar sides which prevent their rotation by the restraining action of adjacent translating pins and with the retaining sidewalls of the pin array. Each of the translating pins may define an internal cavity extending between bottom and tip ends, each being perforated and the apparatus may include a pump for delivering temperature controlled air to each hollow pin tube for flow through the perforations in the bottom end, through the internal cavity, and out through the perforations in the tip end for delivery to cells of the article.

Numerous embodiments may result from the invention, some of which will be described explicitly, each depending upon the type of pin drive system used (clutch or individual motor) and the type of heat delivery system used (heated air or gas which is directed to flow either through-the pins or between-the-pins). Designations A1, A2, B1 and B2 are herein used to identify the different embodiments. The "A" and "B" designations refer to the type of drive system used. The "A" embodiments use a large motor to drive two columns of pins at a time whereby the lead screw of each pin is connected to the rotating input shafts with a timed electric signal to each clutch. The "B" embodiments use individual motors, each with an in-line gear reducer to directly drive the lead screw of each pin or translating member. The four basic embodiments use modular construction with modules having less than or equal to the number of pins in the upper or lower die. Suffix 1 and 2 refer to the type of hot air or other gas delivery method used. Suffix 1-type pins have holes in the tips and bases so that heated air (or gas) can pass through the hollow pins, and suffix 2-type pins use external channels created by the pins' outer geometry to allow heated air (or gas) to pass between the pins. Still another two embodiments are possible (but not described further herein) by combining suffix 1 and 2 methods for each "A" and "B" drive system. Note that the number of possible embodiments may be doubled by considering that each of the previous six embodiments may be configured with only one module each (preferably for the special case of small dies), effectively eliminating the modular design feature. Details of both drive systems, and each heat delivery type are described and shown within. These basic two drive and two heat delivery methods are combined as indicated by the designations to form the four described embodiments.

Modules for both the upper and lower form dies can easily be added or subtracted within the limitations allowed by the overall form tool base plates The base plates can have printed circuitry, electrical connectors, pre-installed wiring and/or bus bars, for motor power, logic, and communication between modules and between modules and computers.

It should be noted that external hydraulic cylinders, or screw jack type devices may also be used to move one or more of the discrete-pin, adjustable form dies. Such external devices could complement the drive systems of the dies shown herein by adding additional adjustment or force application capability. Press-type forming methods, including heated presses, are well known in the art. The addition of such devices are therefore not shown specifically. Hydraulic, pneumatic, screw-type drive systems may therefore be included without changing the spirit of the inventions.

The present disclosure details a reconfigurable approach to forming honeycomb core using a modularized, computer-controlled pair of opposing male/female forming dies. The forming dies utilize an array of pins or members which translate to form three-dimensional male and female external surfaces as hot air is blown through, or between, the discrete pins and through, or into, the cells of the honeycomb core to be formed. The modular design or "building block" approach to discrete tooling not only reduces cost, but facilitates the manufacturing of discrete, reconfigurable tools with respect to repair, maintenance, tolerance build-up, wiring, assembly, and machining processes. The described invention allows the forming sequence and timing of the core deformation to be controlled, using opposing pins to clamp portions of the core as needed.

Two drive system approaches may be used to translate the pins. The first has been described in pending U.S. Pat. No. 5,954,175 issued Sep. 21, 1999 entitled "Modularized Parallel Drivetrain", the entire disclosure of which is incorporated herein in its entirety. It uses modules, each including an input shaft which is geared to two columns of parallel driven shafts. The rotary motion of the parallel driven shafts is converted into translational motion by lead screw and drive nuts which are connected to the pins. A drive gear at the bottom of each parallel driven shaft use right-hand threads or gearing on one column of driven shafts, and left hand threads or gearing on the other column. The modularized parallel drivetrain approach is used to impart translational movement to a large matrix of pins or members in the same direction along many parallel axes simultaneously. The driven shafts are each engaged by individual electromagnetic clutches, and the translational distance required is determined by the duration of a electric signal. Rotary encoders can be connected to the driven shafts to provide feedback if necessary.

A second modular drive system approach has been described in pending U.S. Pat. No. 6,012,314 issued Jan. 11, 2000 entitled "Individual Motor Pin Module", the entire disclosure of which is also incorporated herein in its entirety, and utilizes individual motors to translate each pin. Each module uses an evenly-spaced array of miniature electric motors with in-line gear reducers and in-line rotary encoders. The individual motors are installed into a housing which also contains circuitry for providing local motor-control logic and inter-module communication. The relatively high output speed and low torque of the small motors is converted via the aforementioned gear reducers to lower rotational speed and higher torque. The output shaft of each individual gear reducer turns a lead screw. The lead screws impart translational movement to pins or members which are grouped together in an array, along many evenly-spaced parallel axes simultaneously. Each pin or translational member can therefore be activated to translate a unique distance individually, in any combination, or all of the pins can be translated simultaneously.

Computer control of the pins allows unique capability of fully controlling the forming sequence. Algorithms which minimize local core deformations, control the honeycomb core strain distribution, selectively clamp or secure sections of the core sequentially, and/or provide an allowance for "spring back" may be included. This assures that the honeycomb core is formed precisely. Cool air can be introduced at the proper time in the forming cycle to cool the core and forming tool as desired. The entire forming sequence and the individual pin movements can be controlled by a personal computer, computer work station, or other computer terminal which can support a graphical user interface, or GUI.

For background, it will be appreciated that many types of honeycomb core are traditionally hot-formed on a press. Core articles can be formed on a heated press or oven-heated and formed on a non-heated press, both traditionally using fixed-contour machined or cast dies to impart the needed three dimensional contours to the exterior surfaces. Honeycomb core may also be roll-formed and contour machined to achieve the desired external contours. Roll forming is generally limited to honeycomb core which has ruled surfaces, and cannot be used effectively to produce formed honeycomb core with contours that change in two orthogonal directions, both normal to the direction of the cells.

Since the cost for a set of adjustable forming dies is high relative to the cost for a set of fixed-contour dies, discrete tooling should therefore be considered when few pieces each of a large variety of core details are needed. The converse is generally also true. Formed honeycomb core is generally used in aerospace applications where each aircraft or spacecraft requires a large variety of honeycomb core shapes. Since the economic viability of replacing a honeycomb core forming system using many fixed-contour dies with an adjustable-die system using a single pair of discrete adjustable-contour dies depends upon the number of fixed tools that a set of adjustable dies can replace. Aircraft or spacecraft manufacturing is well-suited to the discrete, adjustable-tooling approach. Additionally, the modular design approach allows the plan form of the discrete, adjustable dies to be changed inexpensively, if needed. Adjustable form dies can be changed rapidly to different length and width combinations by adding or subtracting modules mounted to oversized base plates.

Discrete, self-adjusting form tools which blow heated air through the cells of the core can form the core very rapidly. Additionally, these tools can adapt to many shapes through the use of data files stored within computer memory. When the desired size of the form dies permit, that is, when only small plan form pieces of honeycomb core will be formed, only one module each for the male and female die may be necessary. Large discrete dies composed of large numbers of translating pins or members encounter problems in assembly, wiring, tolerance build-up, and servicing. Additionally, the risk involved with machining tool bases and housings from solid material increases with the number of translating pins or members required for forming. The amount of machining necessary for large discrete dies would therefore be substantial. This causes high tool costs due to the large expenditures required to buy metal stock, then subsequently remove large volumes of metal during machining operations. The concept of "modularity" is additionally needed for discrete tools to allow taking a "building block" approach. The building block approach allows the tool designer to make use of low-cost, high quality castings for gear train or drive motor housings and bases. Control systems for positioning of individual translating pins or members require substantial amounts of wiring which can become a problem when many wires are grouped together in very limited space. The use of modularity as described in the earlier mentioned patents, namely, U.S. Pat. No. 5,954,175 issued Sep. 21, 1999 entitled "Modularized Parallel Drivetrain" and U.S. Pat. No. 6,012,314 issued Jan. 11, 2000 entitled "Individual Motor Pin Module" for large die assemblies offers many advantages over non-modular discrete tool designs. "Modularity", as described, permits the use of distributed control system logic which helps alleviate the problem of handling large quantities of wires in limited space. When using distributed logic, control system circuitry is placed inside each module housing, minimizing external wiring connections.

Since honeycomb core is generally three-dimensionally formed on heated presses at or above room temperature using fixed-contour dies, the strain distribution in the honeycomb core cells is very difficult to control. More distortion than desirable may be imparted to localized groups of cells. Given the ability to alternately clamp and release different portions of the core quickly during the forming operation, the deformation of the honeycomb core could be more desirably controlled such that strain may be more evenly distributed and/or local distortions due to cell buckling or crippling could be reduced. Local core clamping is not presently possible with fixed contour dies.

Troubleshooting, servicing, maintenance, repair and replacement tasks are also difficult to accomplish with discrete, self-adjusting tools without using the modular approach. Repairs, servicing, and maintenance of large discrete tools could otherwise require taking the equipment off-line for a long period of time. Down-time is therefore minimized by having the capability to rapidly replace complete modular assemblies quickly from acceptable spares stock.

The present invention provides numerous advantages over the prior art including:

- greater versatility: contour changes are made by recalling files from computer memory;
- adaptability to changes: stored data can be "tweaked" as needed by changing pin translational data;
- lower space requirements: no extra dies need to be stored;
- greater production output;
- less down time for contour changes; and
- lower overall tooling cost which results from using the described adjustable, discrete heated forming process compared to presently-used fixed-die forming systems when a variety of core shapes must be formed by the same forming machine or system.

The process described herein is also inherently safer to the honeycomb core and to personnel since groups of pins can be used for intermediate core damping to control local strains, and heavy fixed contour dies do not have to be changed with each different core shape needed.

When forming a wide-enough variety of honeycomb core shapes that it is advantageous to use a discrete, adjustable form die method over the typical heated forming press-and-fixed-die method, a modular approach to building larger form dies can offer a lower overall system cost than a non-modular approach. When many modules are put together in a "building block" approach, lower overall cost is achieved by simplifying wiring, assembly, and machining operations. Inherently lower overall risk is also associated with modularization because this approach reduces the magnitude of errors which cause scrap when creating larger-scale tools. Lower risk in this case translates to lower overall cost.

Easier servicing, component replacement, and less down time result when using the modular "building block" approach described herein. Individual modules utilize quick-disconnect electrical plugs, and rapid cross shaft gearing connections so that module replacement can be accomplished with minimum down time. Individual module repair and/or service can then take place off-line.

Still greater versatility can be achieved by inexpensively allowing overall tool plan form size changes. The overall plan form dimensions, that is, length and width, of the active forming area can be changed when using the modular "building block" units to create adjustable form tools. Modules can easily be added or subtracted within the limitations allowed by the overall form tool base plate. The base plate can have printed circuitry, electrical connectors, pre-installed wiring, and/or bus bars for motor power, logic, and communication between modules and between modules and computer(s), all using common parts to lower assembly time and cost. Framing members (if used) around the entire assembly may have to be changed, but their cost would be low compared to replacement of an entire form tool of larger plan form, overall length and width, requirements.

This invention can also claim all of the advantages of adjustable tooling. Many fixed-contour dies can be replaced by the adjustable dies described herein. This represents a significant tooling savings as well as savings In storage space, handling, repair, maintenance and re-work of fixed dies.

Further, the invention described herein can be used for room temperature honeycomb core forming, for example, of aluminum honeycomb core as well as hot forming of Nomex™, graphite, fiberglass, and other nonmetallic honeycomb. The described hardware can also be used to retrofit old fixed die presses.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
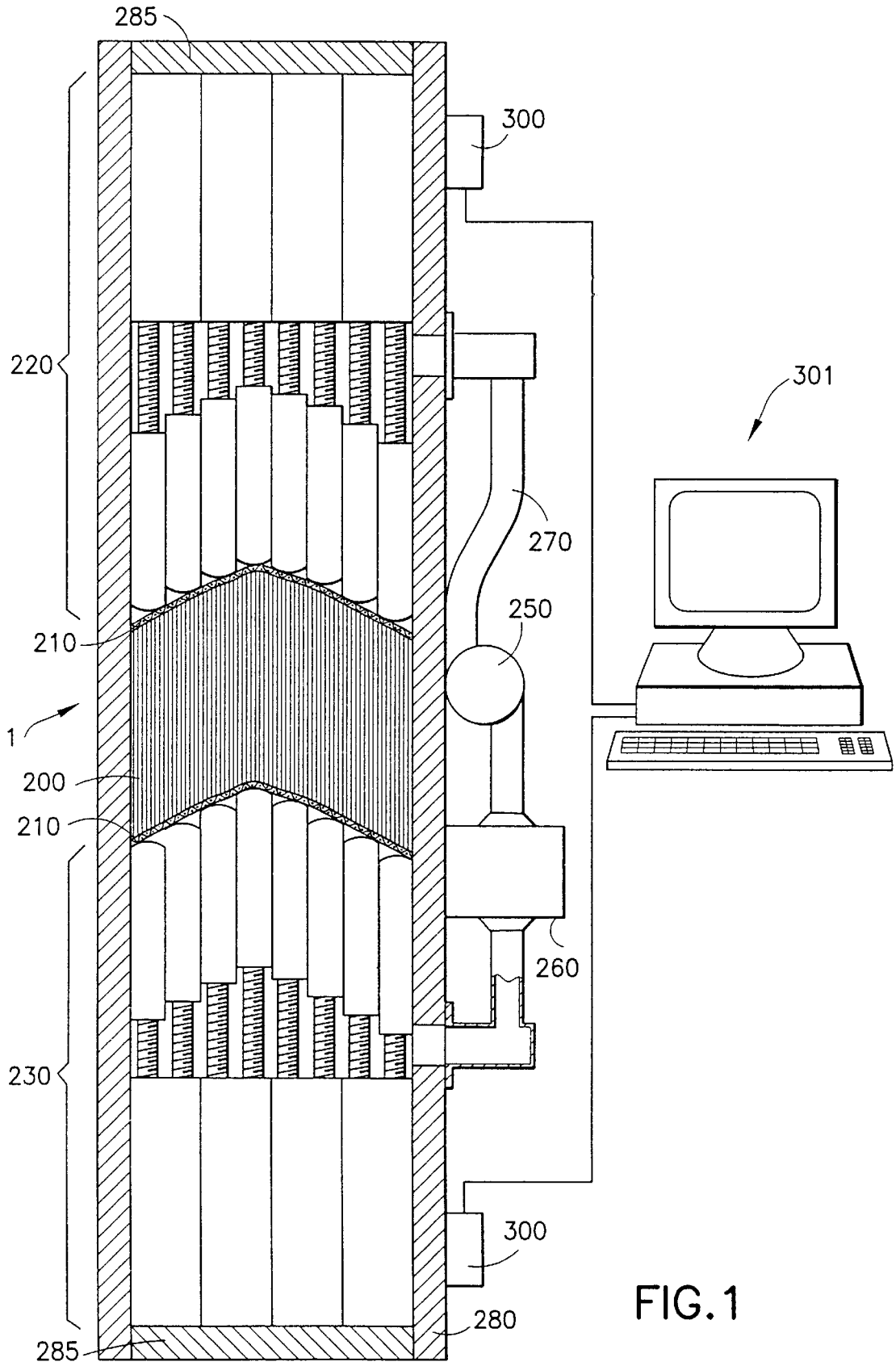
FIG. 1 is an elevation view of apparatus embodying the invention with certain parts broken away and shown in section for clarity.
Figure 2:
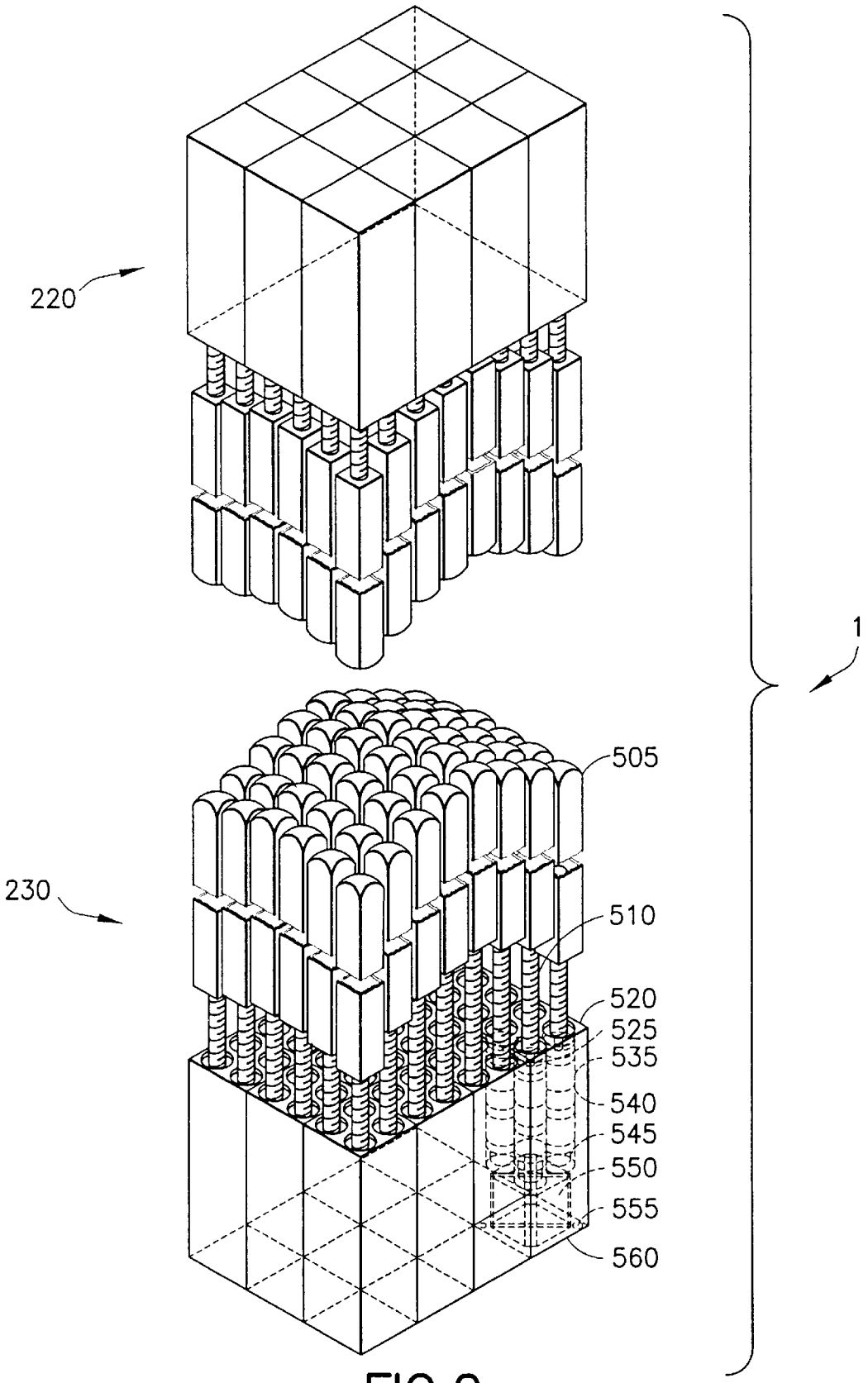
FIG. 2 is an exploded perspective view of the apparatus illustrated in FIG. 1.
Figure 3:
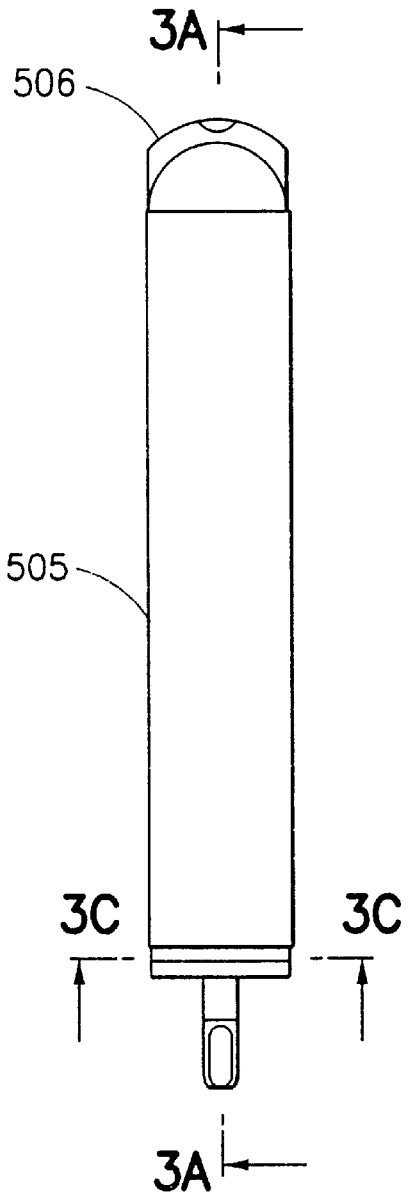
FIG. 3 is a detail elevation view of a translating pin for use with the apparatus of FIGS. 1 and 2 of the type that allows hot air (or gas) to flow through the pin and be diffused into the cells of honeycomb core.
Figure 3A:
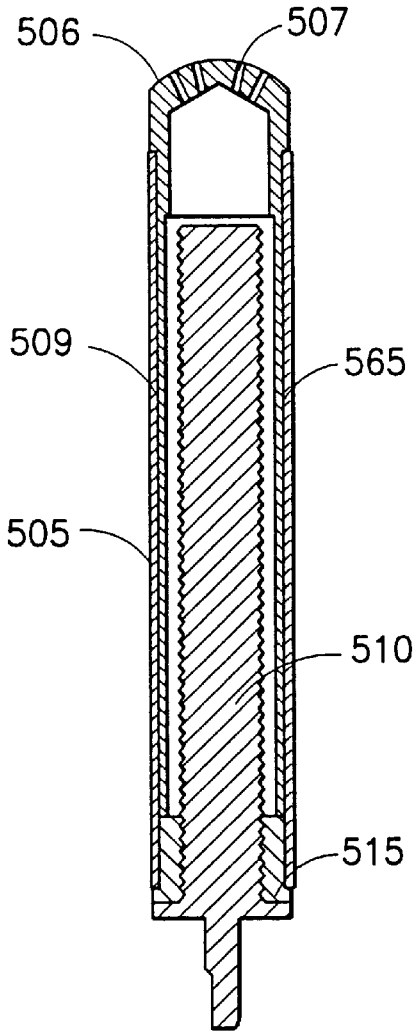
FIG. 3A is a cross section view taken generally along line 3A—3A in FIG. 3.
Figure 3B:
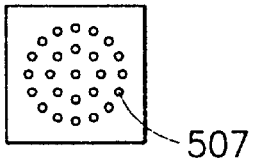
FIG. 3B is a top plan view of the translating pin illustrated in FIG. 3.
Figure 3C:
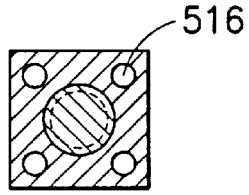
FIG. 3C is a cross section view taken generally along line 3C—3C in FIG. 3.
Figure 4:
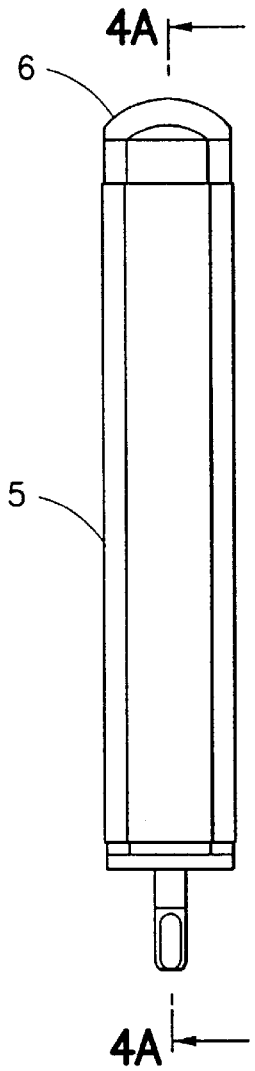
FIG. 4 is a detail elevation view of a modified translating pin, also for use with the apparatus of FIGS. 1 and 2, of the type that allows hot air (or gas) to flow outside of the pins through the cells of the honeycomb core via channels created by the external geometry of the pins when grouped together.
Figure 4A:
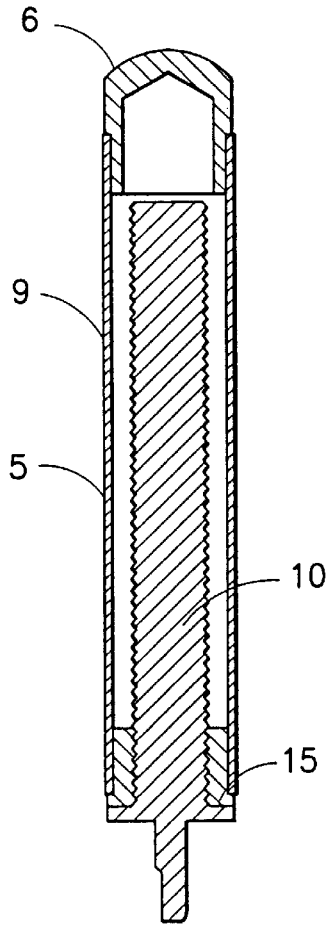
FIG. 4A is a cross section view taken generally along line 4A—4A in FIG. 4.
Figure 5:
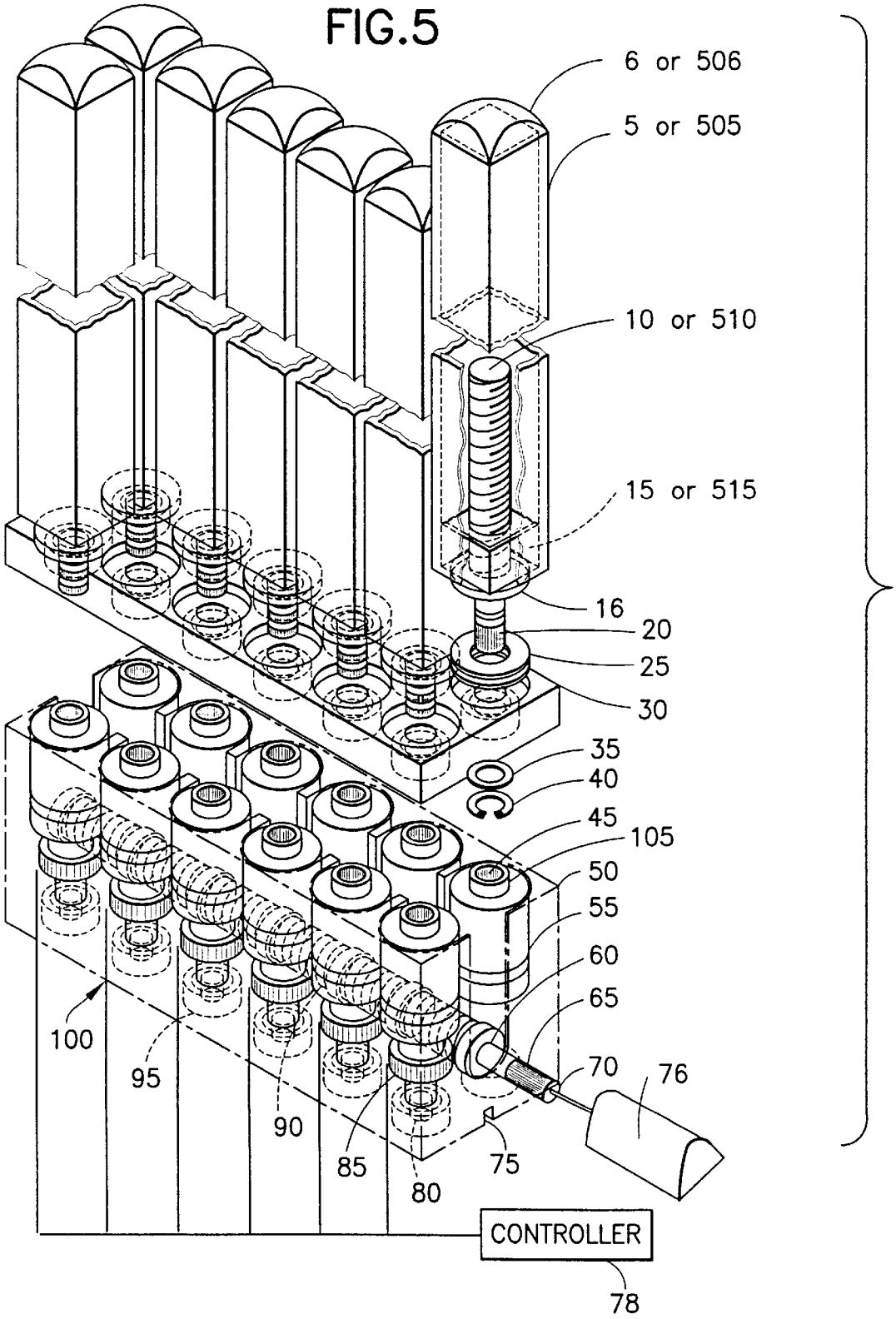
FIG. 5 is an exploded perspective view illustrating a single individual-clutch module using two columns by six rows of translating pins.

Turn now to the drawings and, with reference initially to FIG. 5, Embodiment A of the invention, mentioned above, uses individual clutch drive modules 100 and either suffix 1 or 2 type discrete translating pins or members 5 or 505 as shown in FIGS. 3 and 4, respectively. As seen in FIGS. 1 and 2, an upper die 220 and a lower die 230 may employ the modularized "building-block" approach of adding, or subtracting, common modules 560 (FIG. 2) containing a smaller quantity of clutch-driven lead screw assemblies. Alternatively, if the size of the upper die 220 or lower die 230 permits, one module each may be used having the same number of translating pins 5 or 505 as the upper die 220 or lower die 230. Modules 100 (FIG. 5) containing two columns of eight rows each are shown for convenience, but any number of rows and columns could be used as long as each module 100 is identical. The suffix 1 or 2 heated or cooled air or other gas delivery methods determine how the air or gas is channeled through to and away from the cells of the honeycomb core 200. Alternatively, these two methods could be potentially combined if desired. Both hot and cooled air or gas delivery methods employ a heater or cooler or heat exchanger 260 (FIG. 1) which can supply hot or cool air or gas via vents and/or other controls (not shown) as necessitated during the particular stage of the forming cycle. Methods of supplying cool air are well known in the art and are not specifically part of this invention.

The generic honeycomb core forming tool 1 shown in FIGS. 1 and 2 uses an upper die 220 and a lower die 230 which together form nearly-matched concave/convex surfaces. FIG. 1 shows a generic embodiment of the invention which could use either drive system "A" or "B". The tool is shown with the outer framing members broken away so that the inner components are visible. Insulation, shields, guides, wiring, fasteners, electrical connectors, and hardware have been omitted to emphasize the functionality of the invention. An isometric view of the discrete-translating pin, opposing, matched-die forming methodology is shown in FIG. 2. The individual-motor drive system of Embodiment B is shown for convenience only in this figure, but the drive system of Embodiment A could be used alternatively. Neither holes in the translating pins nor chamfers to allow heated air or gas flow through the core are shown, but either (or both) can be used.

In FIG. 1, an article of honeycomb core 200 is shown between the outer pin tip surfaces of the retracted translating pins. A mesh or interpolating pad 210 is placed on either side of the honeycomb core 200. These high-temperature, open-weave fiber or mesh, pads 210 are used to prevent local crippling or damage to the honeycomb core 200 cell walls and to evenly diffuse heated air or gas through the cells so that fast, even heat-up and cool down is assured. A heater or heat exchanger 260 is shown diagrammatically in FIG. 1 which is used with a blower or pump 250 for air (or gas) circulation. Ducting or hose 270 is used to interconnect the components approximately as shown. The heater or heat exchanger 260 may be a gas, oil, electric, or other type of heater, or a conductive, convective, or radiative-type heat exchanger. Two computer control modules 300 are shown in FIG. 1 which interface with a PC, work station, or other computer terminal 301 which contains a user interface. Although two computer control modules 300 are shown, any number may be used according to the circuit layout for the particular tool. Thermal insulation may be used to prevent motor or clutch overheating, although it is not specifically shown.

Figure 4B:
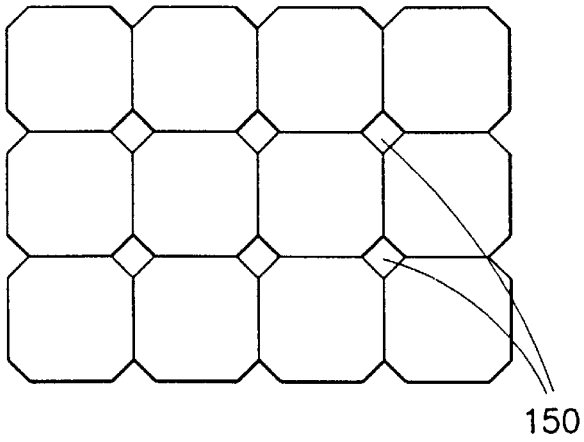
FIG. 4B is a top plan view illustrating a plurality of the translating pins illustrated in FIG. 4 as an array in side-by-side relationship to depict the channels which are formed by grouping the pins together.

Referring to FIGS. 3, 4, and 5, each translating pin 5 or 505 has a tip 6 or 506 and a base or drive nut 15 or 515. The base or drive nut 15 or 515 has internal threads which mate to its respective lead screw 10 or 510. Alternatively, the translating pins 5 or 505 may be bored from solid metal stock and internally threaded a short distance from the base, but it is preferable to make the translating pins from hollow tubes. If the translating pins 5 or 505 are made from hollow tubes, a lead screw base or drive nut (or coupling) 15 or 515 needs to be attached to the end of the pin shank 9 or 509. In suffix 1 (shown in FIG. 3), the lead screw base or drive nut has a plurality of holes 516 drilled or formed to allow the passage of conditioned air or gas into the hollow translating pin and through additional holes 507 or passages in the translating pin tip 506. The translating pins 5 or 505 are translated by the lead screws 10 or 510 which are rotated directly by specific timed electric signal from the control system to apply each individual clutch 55 to connect the flow of rotary power from the input shaft 65 (FIG. 5) to the lead screw 10 or 510. After the translating pin module assembly 100 is inserted into the frame of the forming die apparatus 1, the translating pins 5 or 505 are prevented from rotating by the restraining action of the pins' planar sides against the sides of the tooling frame 285 (FIG. 1). Note that the translating pins 5 or 505 are preferably nominally square, but can be rectangular or of other polygonal shape in cross section, and may or may not have external chamfers or radii 150 (FIG. 4B). The applied clutch 55 therefore rotates the lead screw 10 or 510 and translates each translating pin 5 or 505 a distance proportional to the length of time of the clutch "apply" signal given a steady gear train output shaft 25 rotational speed, for example, from a synchronous motor whose output shaft speed remains fairly constant as loads change within its operating range.

Referring to FIG. 5, the input shaft 65 is driven by an external motor 76. Either one single motor per module can be used to drive an associated module input shaft or a cross shaft can be used to drive columns of parallel modules via one or more external motors. Each motor may or may not have its own gear reduction gearbox, depending upon the required lead screw 10 or 510 speed and input shaft drive gear-to-clutch drive gear ratios 90 and 85. With a 90° (worm) gear drive, for each revolution of the input shaft 65, the clutch drive gear 85 advances one tooth since the input shaft drive gear 90 is a single lead worm gear. If the clutch drive gear 85 has ten teeth, for example, then the gear ratio is 10:1. If an 1800 rpm synchronous motor is connected to the input shaft 65, the lead screw 10 would turn at 180 rpm when the clutch is energized, but this is too fast and high clutch wear, component wear, and poor accuracy would result. The 1800 rpm synchronous motor may need a gear-reduction gearbox connected to it to reduce the speed of the input shaft 65 to something more reasonable, for example, 180 rpm instead of 1800 rpm. Then small differences in clutch apply/release times would have negligible effect on positional accuracy. Power is transmitted from the input shaft 65 to the clutch assembly 55 via the 90° meshing of the input shaft drive gear 90 and clutch drive gear 85 which can be either a worm gear, a helical gear, or some other gear combination as long as a 90° change in power flow is permitted to drive the input side of the clutch assembly 55. The input shaft 65 is supported by bearings 60 which can withstand both radial and axial thrust forces.

The bearings 60 are retained by suitable bearing caps or restraints which can withstand both axial and radial forces. The clutch assembly 55, when deactivated, will not transmit rotary motion to the clutch output shaft 105. Each clutch assembly 55 must be activated by a timed electric signal which connects the flow of power from the clutch drive gear 85, through the clutch assembly 55, to the clutch output shaft 105 and lead screw 10 or 510. A controller 78 including a central processor unit capable of applying these timed signals can be used with either centralized or distributed logic. The controller 78 may operate using either an open-loop mode, that is, no feedback, or a closed loop mode, that is, with optional rotary encoders (not shown) connected to the clutch output shafts 105.

The lead screws 10 or 510 are all threaded to allow the translating component or translating pin 5 or 505 to translate to the bottom of its travel such that the flow of conditioned air or gas is blocked from passing through to the internal or external flow passages. This assures that the air or heated gas flow is directed through the honeycomb core only. Blocks may be added as needed to prevent heated air or gas from being directed other than as desired. Temperature or thermal measurement sensors or devices (not shown) may be included to detect the temperature of the honeycomb core or forming cavity. Spacers (also not shown) may also be used as needed to help locate small core details and allow the tool to adapt to different sizes of honeycomb core. Since linear motion in the same direction from all shafts simultaneously is desired, alternate columns of translating components or translating pins 5 or 505 may have opposite hand threads, or teeth, so that all of the parallel lead screws 10 or 510 can translate simultaneously in the same direction if desired.

Modularized parallel drive trains 100 used in this invention, as described in U.S. Pat. No. 5,954,175 mentioned above, can be connected to one another in series by using male and/or female links between two connected collinear input shafts 65. The modules 100 therefore can be placed side by side and front-to-back, as needed for the required plan form.

Figure 6:
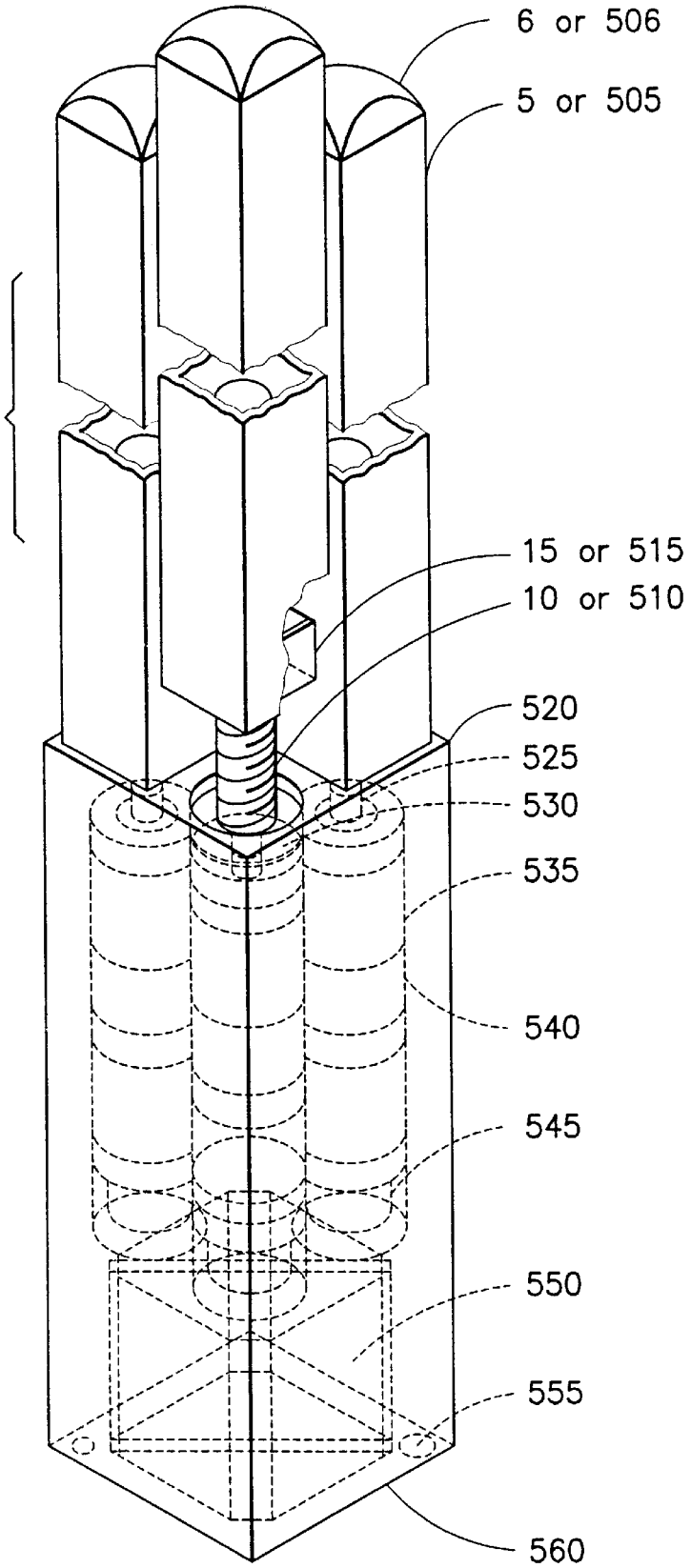
FIG. 6 is an exploded perspective view illustrating a single individual motor module using two columns by two rows of translating pins.

FIGS. 2 and 6 illustrate the modular individual motor drive approach disclosed in U.S. Pat. No. 6,012,314 issued Jan. 11, 2000, also mentioned above. As with the modularized individual clutch drive method, either suffix 1 or 2 translating pins 5 or 505, lead screws 10 or 510, and the like, may be used, either individually or in combination. The prior discussion of the translating pins applies as does the discussion of the overall tool design and operation except as noted herein.

Referring to FIG. 6, the lead screws 10 or 510 are connected directly to the gear train output shafts 525 which in turn receives its rotary motion from the motor 540 via the in-line gear train unit 535. The motor 540 torque therefore translates each translating pin a distance proportional to the amount of gear train output shaft 525 rotation. The gear train 535 can use either planetary or non-planetary gears. These units are readily available commercially and can be connected directly to the motor 540 housing and motor output shaft. Each motor 540 is activated by D.C. power. The controllers for individual-motor and individual-clutch type drive systems are different. The individual motor system uses one D.C. servo motor and one rotary encoder for each pin. The controllers for the individual motor system "count" the number of encoder pulses and compare the count to the required count in a stored internal memory register. The leadscrew 10 is advanced by controlling the servo motor rotation for each pin. In contrast the individual-clutch system controller applies timed DC signals to each clutch 55. A constant rotational speed is therefore needed for each input shaft 65 to assure that the clutch releases when the pin has translated to the proper position. To assure constant rotational speeds, synchronous motors are used.

A controller capable of controlling translating pin motion can be built with either centralized or distributed logic. The distributed logic approach is preferred when building large scale contour tools because the amount of external wiring is greatly reduced. The control system determines how many revolutions (and portions of revolutions) that the motor 540 must revolve and stores the correct number of pulses in local memory. As the motor 540 rotates, the local circuitry counts the number of pulses from the rotary encoder assembly 545. The number of pulsed feedback signals is compared to the target number of pulses stored in local memory for each motor 540, and the motor is stopped when the pulses counted are greater than or equal to the stored target number of pulses. Wiring is therefore needed from the motor 540 encoder assembly 545 to the local circuit board 550, and from the local circuit board 550 to the neighboring circuit modules. Wiring is also needed to the controller (not shown) and to electrical power (also not shown).

In practice, all modules are identical and interchangeable, yet each module can be individually addressed by the system controller. To accomplish this result, the modules communicate using a novel bidirectional ring architecture and communication scheme. In this architecture, a module receives commands and data from a preceding module, that is, one closer to the system controller, and acts on and/or transmits to a succeeding module, that is, one which is farther from the system controller. This provides an extensible mechanism by which any number of controllers can receive a command. For a controller to recognize and act upon a command, it must have been initialized to a valid, unique address. Since all modules are initially configured to have an invalid address stored in EEPROM (Electrically Erasable Programmable Read Only Memory), the system controller first transmits an initialize command with the desired starting address, and the first module accepts this as its address and stores it. This module then increments the address and transmits it to the next module in the ring, which repeats the process. The last module in the ring transmits to the system controller, which receives the initialize command containing an address that is one larger than the total number of modules in the system. By this method, all modules are initialized with unique addresses, and the system controller is made aware of the exact number of modules and their addresses.

In actual use, the pitch of the lead screw 10 or 510 is chosen so that the translating pins 5 or 505 are self-locking under compressive load. Forming loads are transferred from the translating pin 5 or 505 to the lead screw 10 or 510 and then from the lead screw base 15 or 515 to the module base 520. As with the individual clutch method, the translating pins 5 or 505 are prevented from rotating by the restraining action of their planar sides against the inside of the tooling frame 280. Each translating pin module assembly 560 is located via a locating device 555, for example, locating translating pins onto a base plate or frame member 285 which connects to the frame 280 of the form die for enclosing an upper and lower array of translating pin module assemblies 560.

The forming of honeycomb core primarily occurs in the aerospace industry where a large number of honeycomb core details are used to build contoured, strong, highly weight-efficient structures. In the aerospace industry, each aircraft or spacecraft requires many pieces of formed honeycomb core, and the number of formed details is large relative to the quantity of craft produced in a given year. A process that can quickly and easily adapt to produce small quantities each of many different details therefore is well-suited to the aerospace industry. Similarly, other aerospace-related components which utilize hot-forming techniques or presses are candidates for the apparatus and method described herein. Within the aerospace industry, matched-die forming tools may be used to fabricate sheet metal and thermoplastic parts. Of the two, thermoplastic sheets can be contour-formed using the described invention if the forming temperatures are within the thermal limit of the tools' design. Thin gage aluminum sheet metal details could also be formed using this process, although the quality of the resulting parts may not be as high as with present processes.

Other industries in addition to the aerospace industry that need to hold, form, or inspect contoured components can also benefit from the described matched, male/female, discrete modular approach as well. The modular approach can also be used to translate a series of sensors for rapidly digitizing the surfaces of a contoured part or component by replacing the translating pin tips with tips specially-configured to hold sensors or other devices. The digitized data can be directly stored in computer memory for a three-dimensional surface description which can be used by a computer-graphic or numerical control software application. Modular construction adds the ability to isolate and rapidly replace malfunctioning elements by replacing entire modules with spare, off-the-shelf modules. Further repairs can then be implemented off-line. This minimizes down time, and replacement cost. The ability to reconfigure an entire assembly of modules by adding or subtracting modules gives a high degree of versatility which other forming processes might also benefit from.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. Tooling apparatus for forming a three-dimensional honeycomb core article comprising:

a first die module including an array of first elongated mutually parallel translating pins terminating at a tip end and arranged in a matrix for longitudinal movement between retracted and extended positions;

a second die module including an array of second elongated mutually parallel translating pins terminating at a tip end and arranged in a matrix for longitudinal movement between retracted and extended positions, each of said second translating pins being opposedly aligned with an associated one of said first translating pins;

said first and second die modules adapted to receive the honeycomb core article therebetween, said tip ends of said first and second translating pins being engageable with the honeycomb core article;

a controller for moving individually each of said first and second translating pins in a coordinated manner between the retracted and extended positions and into engagement with the honeycomb core article to thereby form the honeycomb core article to a predetermined contour;

a lead screw operable by said controller for moving each of said translating pins between the retracted and extended positions; and wherein each of said translating pins is defined by an elongated shank having internal threads which are correspondingly sized and shaped to mate with an associated one of said lead screws.

2. Tooling apparatus as set forth in claim 1 including a frame for intimately encompassing said first and second die modules; and wherein each of said first and second die modules includes:

a module base, said array of translating pins mounted on said base and movable relative thereto;

a plurality of drive output shafts each drivingly connected with an associated one of said plurality of translating pins;

transmission means disposed in said base for independent driving controllable interconnection of each of said plurality of translating pins with a common rotational drive source; and a controller interconnecting each of said transmission means to effect selective energization of said transmission means and thereby selective translation of one or more of said plurality of translating pins.

3. Tooling apparatus as set forth in claim 2 wherein said translating pins have planar sides and are prevented from rotating by the restraining action of the planar sides of adjacent ones of said translating pins.

4. Tooling apparatus as set forth in claim 2 wherein said transmission means includes:

an input shaft;

drive coupling means attached to said input shaft, and a plurality of input shaft drive gears nonrotatably and concentrically disposed about the input shaft, with each drivingly connectable to a mating input clutch drive gear such that the clutch assemblies each have the clutch drive gear rotatably disposed in journalling openings formed in the module base.

5. Tooling apparatus as set forth in claim 4 wherein each of said clutch drive gears is disposed orthogonally to said input shaft drive gear.

6. Tooling apparatus as set forth in claim 4 wherein each said clutch assembly has an associated output end which drivingly connects with a lead screw drive connector disposed on one extreme end of each of said lead screws.

7. Tooling apparatus as set forth in claim 6 wherein said extreme ends of each of said screw drive connectors are drivingly connected with an associated one of said clutch assemblies.

8. Tooling apparatus as set forth in claim 4 wherein each said clutch assembly is connected to said controller.

9. Tooling apparatus as set forth in claim 1 including a frame for intimately encompassing said first and second die modules; and wherein each of said first and second die modules includes:

a module base, said array of translating pins being mounted on said base and movable relative thereto;

a plurality of drive motors corresponding in number to the number of said array of translating pins;

means including said lead screw interconnecting each of said array of translating pins with said base, each said means being connected independently between said base and a corresponding one of said translating pins;

a controller interconnecting each of said drive means to effect selective energization of said drive means; and wherein each of said translating pins is defined by an elongated shank, with each of said translating pins having internal threads which are correspondingly sized and shaped to mate with a respective lead screw associated therewith.

10. Tooling apparatus as set forth in claim 9 wherein said translating pins have planar sides and are prevented from rotating by the restraining action of the planar sides of adjacent ones of said translating pins.

11. Tooling apparatus as set forth in claim 9 wherein said means for interconnecting each of said plurality of translating pins with said base includes a lead screw, an encoder means and connected gear train each associated with one of said plurality of said translating pins.

12. Tooling apparatus as set forth in claim 9 wherein said drive means includes an encoder means and connected gear train each associated with one pair of said plurality of said translating pins and said motors.

13. Tooling apparatus as set forth in claim 9 wherein each of said translating pins has a drive means and drive train and motor disposed in line with each other.

14. Tooling apparatus for forming a three-dimensional honeycomb core article comprising:

a first die module including an array of first elongated mutually parallel translating pins terminating at a tip end and arranged in a matrix for longitudinal movement between retracted and extended positions;

a second die module including an array of second elongated mutually parallel translating pins terminating at a tip end and arranged in a matrix for longitudinal movement between retracted and extended positions, each of said second translating pins being opposedly aligned with an associated one of said first translating pins;

said first and second die modules adapted to receive the honeycomb core article therebetween, said tip ends of said first and second translating pins being engageable with the honeycomb core article;

a controller for moving individually each of said first and second translating pins in a coordinated manner between the retracted and extended positions and into engagement with the honeycomb core article to thereby form the honeycomb core article to a predetermined contour; and wherein each of said translating pins includes a pin tube having an internal cavity extending from a bottom end having perforations therethrough to said tip end having perforations therethrough; and including:

a source of temperature controlled air; and pump means for delivering air from said source to said bottom of each of said hollow pin tubes for flow through the perforations in said bottom end, through the internal cavity, and out through the perforations in said tip end for delivery to cells of the honeycomb core article.

15. Tooling apparatus as set forth in claim 14 wherein said pump means includes a motor-driven blower; and conduit means for connecting said source to said pump means and said pump means to said bottom ends of said translating pins for introducing the gas from said source to the cells of the honeycomb core article.

16. Tooling apparatus as set forth in claim 14 including:

insulating material on each of said translating pins for minimizing heat transfer thereto from the air flowing to the cells of the honeycomb core article.

17. Tooling apparatus as set forth in claim 14 including:

an open-weave composite pad on either side of the honeycomb core article through which the air can flow as it proceeds from the perforations in said tip ends and toward the cells of the honeycomb core article.

18. Tooling apparatus as set forth in claim 14 wherein said source of temperature controlled air includes:

a heat exchanger capable of supplying heated gas at a temperature range between about 200° C. and 400° C.

19. Tooling apparatus as set forth in claim 14 wherein said source of temperature controlled air includes:

a heat exchanger capable of supplying cooling gas at a temperature range at or below room temperature.

20. Tooling apparatus for forming a three-dimensional honeycomb core article comprising:

a first die module including an array of first elongated mutually parallel translating pins terminating at a tip end and arranged in a matrix for longitudinal movement between retracted and extended positions;

a second die module including an array of second elongated mutually parallel translating pins terminating at a tip end and arranged in a matrix for longitudinal movement between retracted and extended positions, each of said second translating pins being opposedly aligned with an associated one of said first translating pins;

said first and second die modules adapted to receive the honeycomb core article therebetween, said tip ends of said first and second translating pins being engageable with the honeycomb core article;

a controller for moving individually each of said first and second translating pins in a coordinated manner between the retracted and extended positions and into engagement with the honeycomb core article to thereby form the honeycomb core article to a predetermined contour;

wherein each of said translating pins extends between a bottom end and said tip end and is impervious to the flow of air therethrough; and wherein each of said translating pins has an outer peripheral surface chamfered to thereby define longitudinally extending passages intermediate adjoining ones of said translating pins and extending from said bottom ends to said tip ends; and including:

a source of temperature controlled air; and pump means for delivering air from said source to the bottom ends of said hollow pin tubes for flow through the chamfered passages for delivery to cells of the honeycomb core article.

21. Tooling apparatus as set forth in claim 20 wherein said pump means includes a motor-driven blower; and conduit means for connecting said source to said pump means and said pump means to said bottom ends of said translating pins for introducing the gas from said source to the cells of the honeycomb core article.

22. Tooling apparatus as set forth in claim 20 including:

insulating material on each of said translating pins for minimizing heat transfer thereto from the air flowing to the cells of the honeycomb core article.

23. Tooling apparatus as set forth in claim 20 including:

an open-weave composite pad on either side of the honeycomb core article through which the air can flow as it proceeds from the perforations in said tip ends and toward the cells of the honeycomb core article.

24. Tooling apparatus as set forth in claim 20 wherein said source of temperature controlled gas includes:

a heat exchanger capable of supplying heated gas at a temperature range between about 200° C. and 400° C.

25. Tooling apparatus as set forth in claim 20 wherein said source of temperature controlled gas includes:

a heat exchanger capable of supplying cooling gas at or below room temperature.

* * * * *